US006176104B1

(12) United States Patent
Zorini et al.

(10) Patent No.: US 6,176,104 B1
(45) Date of Patent: Jan. 23, 2001

(54) ACTUATOR DEVICE FOR THE CONTROLLED MOVEMENT OF MEMBERS IN KNITTING MACHINES

(75) Inventors: Luigi Omodeo Zorini, Cilavegna; Piermario Rosso, Asti, both of (IT)

(73) Assignee: Luigi Omodeo Zorini (IT)

( * ) Notice: Under 35 U.S.C. 154(b), the term of this patent shall be extended for 0 days.

(21) Appl. No.: 09/459,762

(22) Filed: Dec. 13, 1999

(30) Foreign Application Priority Data

Dec. 23, 1998 (EP) ..... 98830780

(51) Int. Cl.[7] ..... D04B 27/26
(52) U.S. Cl. ..... 66/1 R; 66/232; 66/85 R
(58) Field of Search ..... 310/156; 66/85 R, 66/1 R, 232

(56) References Cited

U.S. PATENT DOCUMENTS

| | | | | |
|---|---|---|---|---|
| 5,111,672 | * | 5/1992 | Gille et al. | 66/84 A |
| 5,133,196 | * | 7/1992 | Tibbals, Jr. | 66/35 |
| 5,170,645 | * | 12/1992 | Lonati | 66/8 |
| 5,187,951 | * | 2/1993 | Stroud et al. | 66/14 |
| 5,259,216 | | 11/1993 | Zorini . | |
| 5,417,087 | * | 5/1995 | Marcello | 66/64 |
| 5,452,590 | * | 9/1995 | Vigili | 66/8 |
| 5,502,987 | | 4/1996 | Zorini . | |

FOREIGN PATENT DOCUMENTS

| | | |
|---|---|---|
| 3609351 | 9/1997 | (DE) . |
| 297 13 979 U | 10/1997 | (DE) . |
| 533630 | 3/1993 | (EP) . |
| 684331 | 11/1995 | (EP) . |
| 2269826 | 2/1994 | (GB) . |
| WO 9301340 | 1/1993 | (WO) . |

OTHER PUBLICATIONS

European Search Report and Annex for Corresponding European Application EP 98 830780.

* cited by examiner

*Primary Examiner*—Andy Falik
(74) *Attorney, Agent, or Firm*—Robert F I Conte; Lee Mann Smith McWilliams Sweeney & Ohlson

(57) ABSTRACT

In a crochet machine for warp knitting, the longitudinal movement of the carrier slide bars is controlled by a plurality of brushless motors each of which incorporates into its structure, a transducer of the angular position of the output shaft and a converter for managing operation of the motor itself based on instructions received from a programmable electronic control unit supervising operation of the whole knitting machine.

6 Claims, 3 Drawing Sheets

ACTUATOR DEVICE FOR THE CONTROLLED MOVEMENT OF MEMBERS IN KNITTING MACHINES

FIELD AND BACKGROUND OF THE INVENTION

The present invention relates to an actuator device or the controlled movement of members in knitting machines including a brushless motor, of the type comprising an electric motor having an output shaft operable in rotation, an electric energizing unit for a controlled supply of power to said motor, a kinematic transmission mechanism for operatively connecting the output shaft of the motor to a member to be operated in a knitting machine.

DESCRIPTION OF PRIOR ART

It is known that in knitting machines such as crochet machines for warp knitting also called crochet galloon looms, formation of an article of manufacture takes a ace by mutual interlacing, following predetermined patterns, of a plurality of warp yarns and weft yarns, suitably engaged by respective knitting members, such as needles, eye-pointed needles and threading tubes, for example.

These knitting members are operated by synchronized cyclic movements, to cause a mutual interlacing of the threads in accordance with the desired knitting pattern.

Generally, the synchronized and controlled movement of the different knitting members takes place by appropriate kinematic mechanisms made up of cams and mechanical-transmission means for example, that directly or indirectly terminate at a main shaft of the knitting machine, driven in rotation by a motor.

Use of the above mentioned kinematic mechanisms however, involves several problems, among which the most important is a limitation in the operating speed of the knitting machine arid, above all, the difficulty of preparing and setting up the machine each time the type or article of manufacture being produced is to be changed or modified, in addition to all problems connected with the production complexity of the kinematic mechanisms themselves.

In order to obviate the above problems, replacement of given mechanical kinematic mechanisms with appropriate servomotors has been proposed, which servomotors, suitably managed by a programmable electronic control unit, carry out operation of the individual knitting members connected thereto.

In his connection, the same Applicant has developed a driving device for the horizontal movements of the carrier slide bars in a crochet machine for warp knitting, in which the traditional cam chains, usually called "Glider chains" are replaced by a series of stepping motors each of them being connected with one of the carrier slide bars by a connecting rod-crank linkage. Thus, each carrier slide bar is driven in a reciprocating motion in a longitudinal direction, the oscillation amplitude of said bar varying in accordance with predetermined patterns, as a result of angular rotations given to the output shaft of the respective motor according to angular amplitudes correlated with the breadth of the horizontal translation to be transmitted to the bar.

In more detail, each stepping motor s is Managed by an energizing unit electrically activating it in an appropriate manner, depending on the instructions received by a programmable electronic control unit supervising operation of all stepping motors mounted on the knitting machine.

Power supply to each stepping motor takes place by electric-pulse trains, where each pulse corresponds to one rotation of the motor shaft corresponding to a predetermined angular "pitch".

Following a given instruction received from the electronic control unit, the energizing unit will transmit a pulse train to the respective motor, the number of said pulses being adapted to impose an angular rotation of the desired amplitude to the output shaft, which is correlated with the breadth of the translation to be transmitted to the carrier slide bar.

Since the angular displacement carried out by the output shaft is directly correlated with the number of electric pulses sent to the motor, operation by a stepping motor is conceived as operation with a so-called open-loop control system without feedback. In other words, control of operation of each motor exclusively relies on the number of electric pulses contained in the individual pulse trains which are sent each time to the motor, and no detection is carried out, during accomplishment of the angular rotation, for the purpose of controlling how the rotation actually takes place.

The only verification carried out in known devices is that of ascertaining with the aid of appropriate sensors and after the movement has occurred, whether the preestablished position of the output shaft and/or the carrier slide bar has been reached or not.

The above devices being the object of patents EP 5333630 and EP 654331, have brought important improvements as compared with traditional kinematic mechanical mechanisms.

In particular, important advantages have been achieved in terms of simplification of the operations for setting up the machine each time the type of article of manufacture being produced is to be modified or charged.

In fact the knitting machine lends itself to be set for a new production by merely loading the program relative to the type of article of manufacture to be produced, into the electronic control unit.

However, it has been found that the above mentioned devices using stepping motors still have some problems as regards operation at high operating speeds. In particular, the Applicant has found that these problems essentially result from the fact that operation of stepping motors is such that each motor has a tendency to immediately cause stopping of translation in coincidence with the desired angular position of the output shaft and therefore has a tendency to impose important decelerations to all mechanical members connected to the output shaft itself. However, due to the masses of the components connected with the output shaft, actually it is impossible to obtain an immediate stopping of the translation. On the contrary, stopping occurs aster a short transitory period of time in which the carrier slide bar, or another member connected to the output shaft, performs several oscillations around the nominal stopping point. This phenomenon is emphasized by the fact that, at the nominal stopping point, the stepping motor appears to be unable to produce important torques in opposition to outer forces such as those due to inertia tending to cause rotation of the output shaft.

As a result, in spite of the fact that stepping motors have been conceived In a manner adapted to cause an instantaneous stop of their movements, for the above described reasons they do not appear capable of stopping the carrier slide bars at the exact stop position of their movement in a sufficiently quick manner.

Attempts have been made to obviate these problems by trying to make the carrier slide bars and the kinematic transmission mechanisms as light in weight as possible, but improvements thus achieved are very modest if compared with market requirements.

It has been also found that the great number of electric connections between each energizing unit and the respective motor, carried out as physically distinct and separated units, imposes adoption of particular precautions aiming at neutralizing the effects of electromagnetic waves emitted from the motors themselves and/or other members associated with or close to the knitting machine, that would bring about further negative effects on the operating reliability and precision of the machine taken as a whole.

SUMMARY OF THE INVENTION

In accordance with the present invention, it has been found that the problems of the known art can be brilliantly solved if, instead of the stepping motors, electric motors of the brushless type are used, i.e. electronic-commutation permanent-magnet synchronous In particular, it is an object of the present invention to provide an actuator device for the controlled movement of members In knitting machines, wherein said electric motor is a brushless motor.

It is a further object of the invention to provide a knitting machine, in particular a crochet machine for warp knitting, equipped with at least one actuator device in accordance with the Invention, as well as use of a brushless motor for movement of members in knitting machines and a method of moving carrier slide bars in crochet machines or warp Knitting put into practice with the aid of said brushless motor.

Further features and advantages will become more apparent from the detailed description of a preferred, non-exclusive, embodiment of an actuator device for the controlled movement of members in knitting machines, in accordance with the present invention.

This description will be taken hereinafter with reference to the accompanying drawings, given by way of non-limiting example.

DESCRIPTION OF THE PREFERRED EMBODIMENTS

Figure 1:
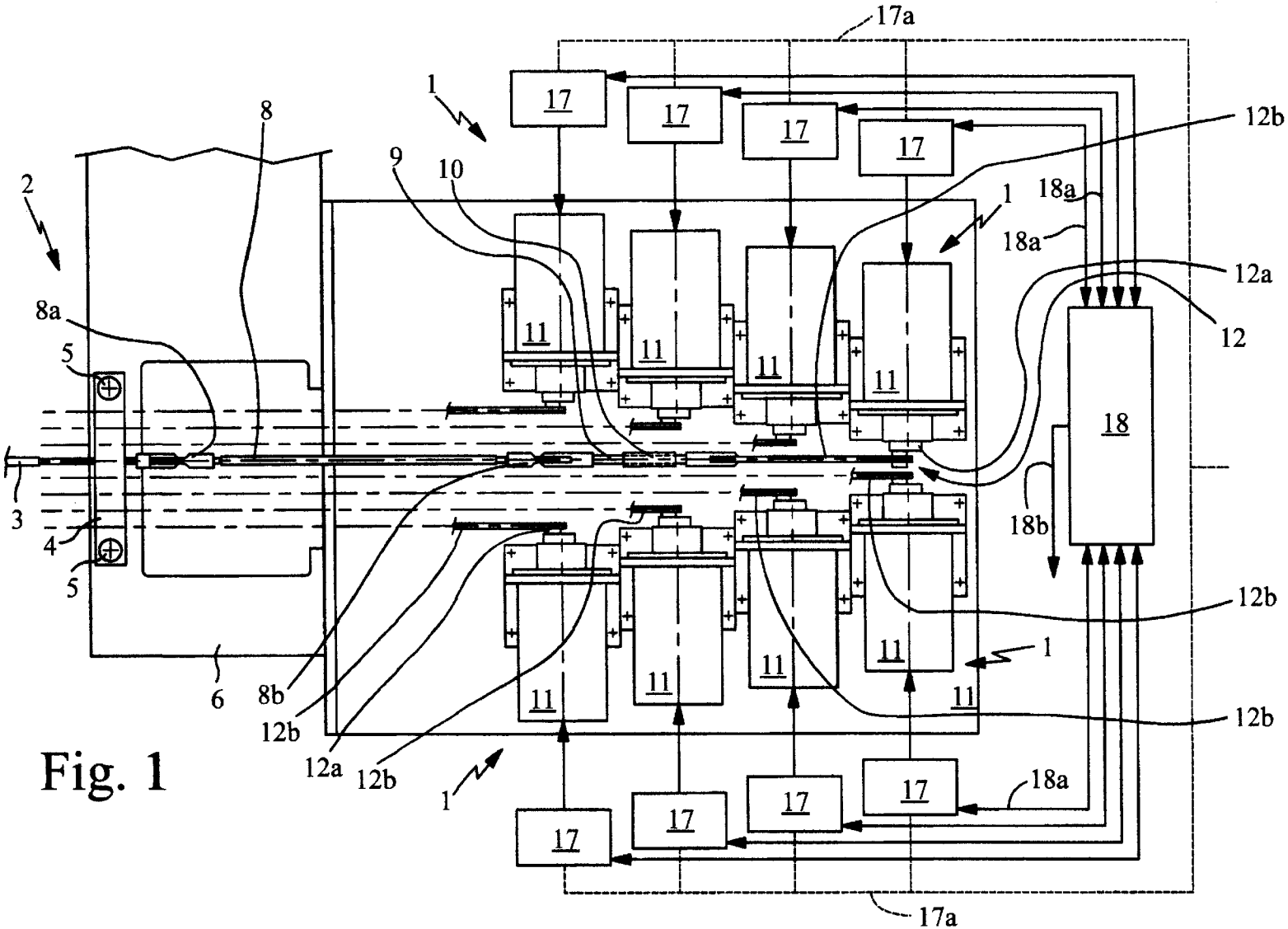
FIG. 1 is a diagrammatic plan view of a plurality of actuator devices in accordance with the invention associated with a crochet machine.
Figure 2:
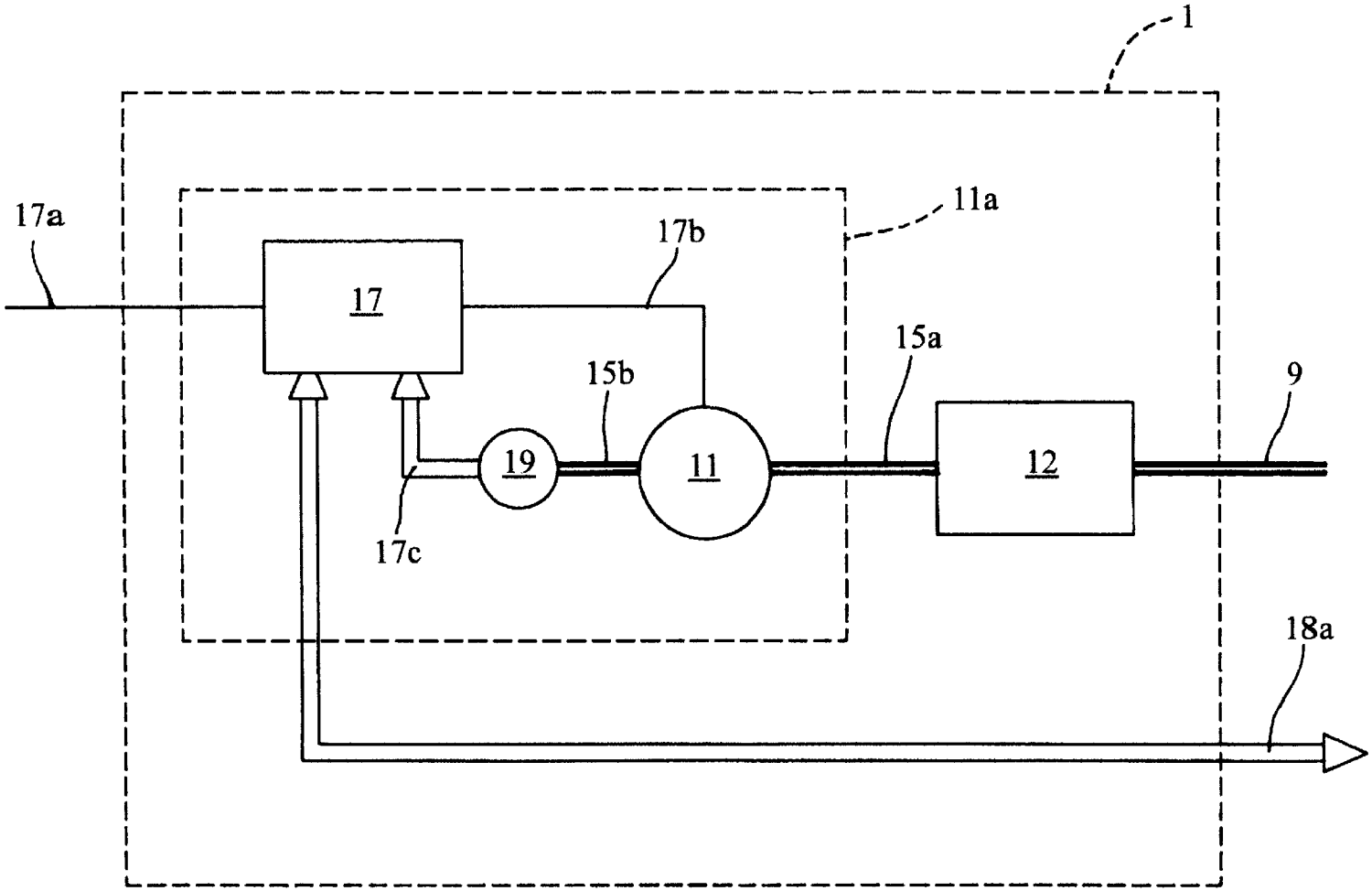
FIG. 2 is a block diagram of a device in accordance with the invention.

A device 1 is associated with a knitting machine and more specifically a crochet machine for warp knitting or a crochet galloon loom 2, only partly illustrated and not described in detail as known per se.

Each device 1 is arranged for operation on at least one carrier slide bar 3, to cause a reciprocating motion of the latter in a longitudinal direction, in synchronism with the movements of other knitting members usually associated with the machine 2 and not shown as known per se and not of importance to the ends of the invention.

In a manner known per se, the carrier slide bars 3 carry a plurality of threading Lubes, not shown, engaging respective waft threads and are operatively supported by at least too lifting plates 4 (only one of which is shown) slidably engaging them in a horizontal direction coincident with the longitudinal extension of the carrier slide bars.

The lifting plates 4 are slidably guided in a vertical direction on respective pairs of guide rods 5 integral with a base 6 of the knitting machine 2, and are simultaneously driven in a reciprocating motion along said rods by a kinematic mechanism Drown per se, housed in the base 6.

Combination between said vertical oscillatory motion and horizontal oscillatory motion, imparted to each carrier slide bar 3 by the respective device 1, is such that the threading tubes carried by the bar itself are operated in a reciprocating motion following a substantially curved path extending astride one or more knitting needles arranged in the machine 2.

Each carrier slide bar 3 is connected to the respective actuator device 1 by a driving rod 8 having one end 8*a* connected to the carrier slide bar itself, and a second end 8*b* connected to an intermediate rod 9 in turn in engagement with the actuator device and slidably guided along a fixed guide element 10.

All that being stated, each actuator device 1 comprises an electric motor 11 which is fixed relative to the base 6 and is operatively connected to the respective carrier slide bar 3 by a kinematic transmission mechanism generally denoted by 12. In more detail, in accordance with the present invention, motor 11 is a brushless motor, i.e. an electronic-commutation permanent-magnet synchronous motor.

Figure 3:
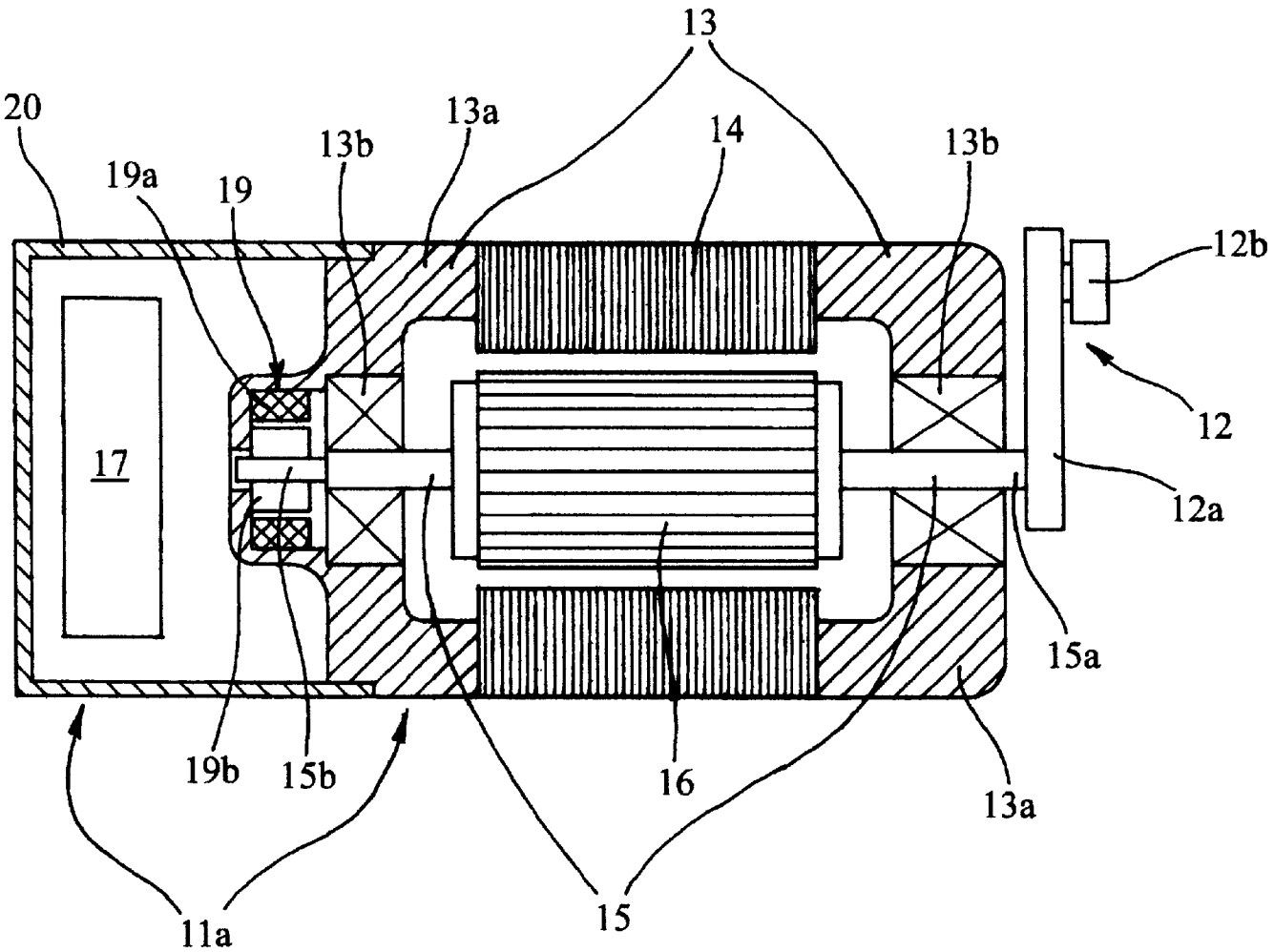
FIG. 3 is a longitudinal cross-section view diagrammatically showing a device in accordance with the invention.

As clearly shown in FIG. 3, the brushless motor 11 essentially comprises a protection structure 13 comprising two end shells 13*a* for example, rigidly carrying a stator 14 comprising a three-phase winding, or example. The protection structure 13 rotatably engages, by means of two bearings 13*a* placed at the opposite ends of the structure itself, an output shaft 15 rigidly carrying a rotor 16, of the permanent-magnet type preferably made of neodymium-iron-boron.

Mounted on one end 15*a* of the output shaft 15 external to the protection structure 13 is the kinematic transmission mechanism 12 that, in a preferential embodiment of the invention, preferably comprises a crank 12*a* directly fitted onto the end of the output shaft and a connecting rod 12*b* connected to said intermediate rod 9.

Associated with each brushless motor 11 is an electric energizing unit 17 for a controlled supply of power to the motor itself. The energizing unit 17, usually called "converter" suitably supplies the electric motor 11 with power on the basis of the received instructions, through a preferably serial connecting line 18*a*, from a programmable electronic control unit 18, the motor itself being such activated that the output shaft 15 will carry out angular displacements of a predetermined amplitude to which the desired oscillations to be imparted to the corresponding carrier slide bar 3 correspond, based on the work program stored in the electronic control unit.

It is to note that, in the presence of kinematic transmission mechanisms 12 of the connecting rod 12*b*—crank 12*a* type as provided in the illustrated embodiment, the angular displacement of the output shaft 15 of each device 1 will preferably be lower than 360°.

As clearly shown in FIG. 1, the electronic control unit supervises operation of all actuator devices 1 and preferably it is also interfaced, by an auxiliary signal output 18*b*, with the main motor of the knitting machine 2 in order to manage the whole operation thereof and synchronize the actuator devices 1 with all the other members of the machine itself.

Preferably, each converter 17 comprises, in a manner known per se, a plurality of valves of the IGBT type for creating a controlled bridge suitably powering the windings of stator 14. The IGBT valve bridge is supplied with direct current through a feeder line 17*a* connected in parallel to the converters 17 belonging to the other devices 1. Advantageously, each converter 17 supplies the respective motor 11 following a sinusoidal-operation technique. In other words, the opening and closing sequences of IGBT valves constituting the controlled bridge are managed and modulated in such a manner that the loadless electromotive force on motor 11, at normal working conditions, has a sinusoidal course.

It is also to point out that each converter 17 preferably has an operating feature of the so-called "four-quadrant" type, i.e. it manages operation of motor 11 both as a true motor and as a generator/brake, in both rotation directions.

Under this circumstance, connection in parallel of the different converters 17 on the feeder line 17*a* is advantageous because it enables the energy fluxes to be mediated, using the fact that accelerations and decelerations of the carrier slide bars 3 or other loads during operation are not usually completely coincident or the different devices 1.

Thus it is possible to give more favorable sizes to the different power elements, such as capacitors and braking resistors associated with devices 1.

Operatively interposed between converter 17 and motor 11 is a transducer 19, consisting of a so-called "resolver" intended for sending to the converter itself, signals indicating the angular position taken by the output shaft 15, instant by instant.

These signals are processed and interpreted by converter 17, for managing activation of motor 11 according to said sinusoidal-operation technique, as well as controlling the correct execution of the displacement carried out by the corresponding carrier slide bar, instant by instant.

In other words, interaction between converter 17 and transducer 19 performs a so-called "closed-loop control of the direct type" on motor 11, carrying out instantaneous modifications, if required, in the motor-supply modality for ensuring the correct execution of the displacement of the carrier slide bar 3.

Advantageously, converter 37 and transducer 19 are substantially integrated into motor 11 to define a single body 11*a* therewith, in such a manner that connection 17*b* between converter 17 and motor 11, as well as connection 17*c* between transducer 19 and the converter itself, are housed inside the protection structure 13 of the motor itself.

In more detail, for the purpose it is provided that converter 17 should be housed in an auxiliary holding portion 20 being part of the protection structure 13 and placed on the opposite side from the kinematic transmission mechanism 12.

Transducer 19, preferably of the "brushless-frameless" type, has a fixed portion 19*a* housed in a seating 21 arranged in the protection structure 13, and a movable portion 19*b* fixed to a second end 15*b* of the output shaft 15, on the opposite side from the end 15*a* carrying the kinematic transmission mechanism 12.

Incorporation of converter 17 and transducer 19 in the structure of the respective motor 11 enables important advantages to be achieved in terms of operating Reliability, in that the electric connections 17*b*, 17*c* between said components are of a very reduced length and completely enclosed within the protection structure 13.

This situation is very favorable for reducing emission of electromagnetic radiations, as well as for protection of motor 11, converter 17 and transducer 19 against radiations from the outside.

In Fact, device 1 can be equipped with only two electric connectors appearing externally of the box-shaped protection portion of the converter, i.e. a power connector for connection to the feeder line 17*a*, and a signal connector for connection to the electronic control unit 18.

The present invention achieves the intended purposes.

Use of brushless motors substantially employed in a manner adapted to emulate stepping motors for moving carrier slide bars as above described, and more generally for the controlled movement of any other member of a knitting machine has enabled unexpected advantages in terms of accuracy of the movement control.

In fact, it has been found that the brushless motor has such construction features that, once the desired positioning of the output shaft has been reached, the reached position keeps its fixed condition in a much stronger manner than with stepping motors. In fact, the output shaft keeps a fixed position even in the presence of outer torques applied to the output shaft itself, due to the high restoring torques generated by the electromagnetic forces obtained by suitably power-supplying the stator windings.

When stepping motors are instead used, unlike that which can be found in the device in reference, torques produced on the rotor when the output shaft has stopped at a given angular position are of a relatively low amount, so that small angular oscillations of the shaft relative to the predetermined position under the influence of outer mechanical stresses, are not prevented. The Applicant has further found that these oscillations, even if of slight amount, are one of the main causes limiting operating accuracy and reliability of the knitting machine, above all at high speed. Stopping of translations of the carrier slide bars in fact is not immediate, in that slight oscillations of the latter relative to a predetermined stop point occur over a short gap.

On the contrary, the high torque produced on the rotor under static conditions by brushless motors enables the above mentioned problems to be eliminated, or at least greatly reduced, so that operation of the knitting machine at much higher speeds than with stepping motors will be made possible.

In addition, accomplishment of a closed-loop control of the direct type on the motor operation, allowed by the adoption of brushless motors, enables operation of the motor itself to be piloted according to much more marked accelerations or, in case of need, much less violent accelerations than with stepping motors. This aspect too is advantageous for achieving greater operating speeds.

Reliability in operation is further increased by eliminating the problems connected with electromagnetic interferences and emissions found in the known art, by virtue of integrating the converter and transducer into the structure of the respective motor.

It is to note that integration of the motor, the converter and the transducer into a single unit is also advantageous as regards adaptability and transformability of the knitting machine for carrying out different works. it is in fact possible to easily arrange many housings on the knitting machine for mounting of actuator devices 1 that might be necessary if further carrier slide bars 3 or knitting members of different type should be wished to be added to the machine itself.

What is claimed is:

1. An actuator device for the controlled movement of members in knitting machines, comprising:

an electric brushless motor (11) having an output shaft (15) operable in rotation;

an electric energizing unit (17) directly fastened to the brushless motor for a controlled supply of power to said motor (11);

a transducer integrated into the motor itself and operatively connected with the energizing unit for sending to the energizing unit feedback signals responsive to the angular position taken by an output shaft of the brushless motor;

a kinematic transmission mechanism (12) for operatively connecting the output shaft (15) of the motor (11) to a member (3) to be operated in a knitting machine (2).

2. A device as claimed in claim 1, wherein said brushless motor (11) is controlled by said energizing unit (17) according to a sinusoidal-operation technique.

3. A device as claimed in claim 1, wherein said energizing unit (17) is housed in a holding portion (20) being part of a protection structure (13) of said motor (11), so that an electric connection between said motor (11), said transducer (19) and said energizing unit (17) are disposed within said protection structure.

4. A device as claimed in claim 1, wherein said transducer comprises one fixed portion (19*a*) housed in a seating (20) arranged in a protection structure (13) of the motor (11) and one movable portion (19*b*) fastened to the output shaft (15).

5. A device as claimed in claim 1, wherein said kinematic transmission mechanism (12) comprises a connecting rod-crank linkage, the crank (12*a*) of which is directly fastened to one end of an output shaft (15) of said motor (11).

6. A crochet machine for warp knitting, comprising a plurality of carrier slide bars each operable in a longitudinal reciprocating motion according to a longitudinal direction wherein the longitudinal reciprocating motion of each carrier slide bar is controlled by an actuator device comprising:

an electric brushless motor having an output shaft operable in rotation;

an electric energizing unit directly fastened to the brushless motor for a controlled supply of power to said motor;

a transducer integrated into the motor itself and operatively connected with the energizing unit for sending to the energizing unit feedback signals responsive to the angular position taken by an output shaft of the brushless motor;

a kinematic transmission mechanism for operatively connecting the output shaft of the motor to a member to be operated in a knitting machine.

* * * * *